US011142951B2

(12) United States Patent
Schneid et al.

(10) Patent No.: US 11,142,951 B2
(45) Date of Patent: Oct. 12, 2021

(54) LADDER STANDOFF AND LADDER INCORPORATING THE STANDOFF

(71) Applicant: Lorad, LLC, Westlake, OH (US)

(72) Inventors: Jeffrey Schneid, Avon Lake, OH (US); Nick Cerri, Cleveland, OH (US)

(73) Assignee: LORAD, LLC, Westlake, OH (US)

( * ) Notice: Subject to any disclaimer, the term of this patent is extended or adjusted under 35 U.S.C. 154(b) by 0 days.

(21) Appl. No.: 16/193,936

(22) Filed: Nov. 16, 2018

(65) Prior Publication Data

US 2020/0157885 A1 May 21, 2020

(51) Int. Cl.

| | |
|---|---|
| ***E06C 7/48*** | (2006.01) |
| ***E06C 7/50*** | (2006.01) |
| ***E06C 7/18*** | (2006.01) |
| ***E06C 7/16*** | (2006.01) |
| *E06C 9/02* | (2006.01) |
| *E06C 7/00* | (2006.01) |

(52) U.S. Cl.

CPC ..... *E06C 7/505* (2013.01); *E06C 7/16* (2013.01); *E06C 7/182* (2013.01); *E06C 7/48* (2013.01); *E06C 7/006* (2013.01); *E06C 9/02* (2013.01)

(58) Field of Classification Search

CPC . E06C 7/48; E06C 7/482; E06C 7/484; E06C 7/486; E06C 7/488; E06C 9/02; E06C 7/505

See application file for complete search history.

(56) References Cited

U.S. PATENT DOCUMENTS

| | | | | |
|---|---|---|---|---|
| 3,157,248 A | | 11/1964 | Nesslinger et al. | |
| 3,419,109 A | * | 12/1968 | Costlow | E06C 7/48 182/214 |
| 3,486,580 A | * | 12/1969 | Norton | E06C 7/48 182/214 |
| 3,902,700 A | | 9/1975 | Cox | |
| 4,189,029 A | | 2/1980 | Jordan | |

(Continued)

FOREIGN PATENT DOCUMENTS

| | | |
|---|---|---|
| CN | 106761362 A | 5/2017 |
| CN | 206352477 U | 7/2017 |

(Continued)

OTHER PUBLICATIONS

CN106761362A—Machine translation attached.
CN206352477U—Machine translation attached.
CN206928894U—Machine translation attached.

*Primary Examiner* — Colleen M Chavchavadze
(74) *Attorney, Agent, or Firm* — Curatolo Sidoti Co., LPA; Salvatore A. Sidoti

(57) ABSTRACT

A ladder standoff includes at least one bent plate that is configured to be detachably engaged with at least one ladder rung of a ladder by at least one connection plate that is configured to be detachably connected to the bent plate and to the ladder rung. The ladder standoff may be attached to a ladder and used to secure a ladder to a vertically-extending building wall structure at a selected distance. The length of the ladder standoff can be extended in a substantially horizontal direction in relation to the vertically extending ladder and vertically extending building wall to provide a ladder standoff with variable lengths to accommodate different distances between the ladder and the surface of the vertically extending building wall.

17 Claims, 6 Drawing Sheets

(56) References Cited

U.S. PATENT DOCUMENTS 4,280,590 A * 7/1981 Polizzi ..... E06C 7/48 182/107
4,331,217 A 5/1982 Stecklow
4,440,263 A 4/1984 Smith
4,548,293 A * 10/1985 Haab ..... E06C 9/02 182/106
4,823,912 A * 4/1989 Gould ..... E06C 7/484 182/107
5,033,582 A * 7/1991 Hoben ..... B60R 3/02 182/106
5,180,032 A * 1/1993 Hidalgo ..... E06C 7/48 182/107
5,601,154 A 2/1997 Eisenmenger
5,664,643 A * 9/1997 Taylor, Jr. ..... E06C 7/48 182/107
5,788,198 A * 8/1998 Sharpe ..... E06C 7/16 248/210
5,855,252 A 1/1999 Vrolyks
6,003,630 A 12/1999 Whalen
6,029,774 A * 2/2000 Cothern ..... E06C 7/188 182/107
6,095,283 A * 8/2000 Ellis ..... E06C 1/38 182/106
6,354,401 B2 * 3/2002 Murray ..... E06C 1/34 182/107
6,401,861 B1 6/2002 Marszalek
6,405,828 B1 6/2002 Redding
6,550,577 B1 * 4/2003 Allgire ..... E06C 1/34 182/107
6,619,428 B2 * 9/2003 Ellis ..... B60R 3/005 182/106
6,681,893 B1 1/2004 Coulson
7,377,360 B1 5/2008 Misiak et al.
7,789,199 B2 9/2010 Wollenberg et al.
8,047,330 B1 * 11/2011 English ..... E06C 7/48 182/117
8,235,175 B1 8/2012 Feldhaus
8,616,335 B1 12/2013 Mosier
D712,567 S 9/2014 Hollister
8,944,211 B2 * 2/2015 Blaska ..... E06C 9/08 182/97
9,010,490 B1 4/2015 Mosier
9,038,778 B1 5/2015 Carter et al.
9,206,643 B2 12/2015 Kerr et al.
9,347,264 B2 5/2016 Mosier et al.
9,540,875 B2 * 1/2017 Ellis
9,637,975 B2 * 5/2017 Melton ..... E04G 1/34
2007/0227819 A1 * 10/2007 Layfield ..... E06C 7/42 182/206
2011/0253479 A1 * 10/2011 Gandy ..... E06C 7/486 182/107
2012/0061179 A1 * 3/2012 English ..... E06C 7/48 182/121
2012/0175188 A1 7/2012 Xu
2016/0215563 A1 * 7/2016 Ellis ..... E06C 7/48
2017/0101823 A1 * 4/2017 Yenser ..... F03D 80/80

FOREIGN PATENT DOCUMENTS

CN 206928894 U 1/2018
GB 2476283 A 6/2011

* cited by examiner

LADDER STANDOFF AND LADDER INCORPORATING THE STANDOFF

TECHNICAL FIELD

The present disclosure is directed to a ladder standoff for attachment to a ladder and a ladder incorporating the ladder standoff.

BACKGROUND

According to a 2014 report from the United States Centers for Disease Control and Prevention, in 2011 alone, ladder falls resulted in 113 deaths, 15,460 non-fatal injuries where a worker had to miss at least one day of work due to the injury, and an estimated 34,000 non-fatal injuries that resulted a person in seeking treatment at a hospital emergency department. These injuries and losses of life are tragic enough, but adding to that is the loss of skilled workers, work productivity, and medical and/or legal expenses that may result.

To minimize the risk of injury or fatality, the Occupational Safety and Health Administration ("OSHA") has passed regulations for the use of ladders in general industry (29 CFR Part 1910 Subpart D (2017)). 29 CFR 1910.23(d) governs the standards for fixed ladders. A fixed ladder is a ladder that includes side rails and individual horizontal rungs attached to the side rails. 29 CFR 1910.23(d)(2) specifically requires that employers ensure that the minimum perpendicular distance from a fixed ladder to the nearest permanent object in the back of the ladder be 7 inches. The minimum 7 inch distance is what OSHA believes is necessary for a worker to get a safe foothold on the rungs of a fixed ladder. The surfaces of vertical building walls are not always uniform and often include protrusions that impact the 7 inch minimum perpendicular distance required by 29 CFR 1910.23(d)(2). Ladders include standoffs to distance the ladder from the building wall surface. Many ladder standoffs are welded directly to the ladder and have a fixed length. These welded ladder standoffs of fixed length are not able to accommodate wall surfaces with protrusions of varying sizes.

SUMMARY

Provided is standoff for a ladder. The ladder standoff comprises a first plate having a first portion for engaging a surface and a second portion substantially perpendicular to said first portion including at least one opening configured for receiving a fastener, a first connection plate configured to detachably couple said first plate to a rung of a ladder, said first connection plate including at least one opening configured for receiving a fastener, wherein at least one of said first plate and said first connection plate includes a plurality of openings spaced along at least a portion of the length of said first plate and/or first connection plate, and wherein said ladder standoff is horizontally adjustable.

Also provided is ladder comprising spaced apart and substantially parallel elongated side rails, a plurality of vertically spaced apart ladder rungs extending horizontally between said elongated side rails, and at least one ladder standoff detachably connected to at least one of said ladder rungs, said ladder standoff comprising a first plate having a first portion for engaging a surface and a second portion substantially perpendicular to said first portion including at least one opening configured for receiving a fastener, a first connection plate configured to detachably couple said first plate to a rung of a ladder, said first connection plate including at least one opening configured for receiving a fastener, wherein at least one of said first plate and said first connection plate includes a plurality of openings spaced along at least a portion of the length of said first plate and/or first connection plate, and wherein said ladder standoff is horizontally adjustable.

BRIEF DESCRIPTION OF THE DRAWINGS

The accompanying drawings are included to provide a further understanding of the ladder standoff and ladder disclosed herein, and are incorporated in and constitute a part of this specification. The drawings illustrate embodiments of the ladder standoff and ladder disclosed herein and, together with the description, serve to illustrate the embodiments described herein, but are not intended to limit the specification or any of the claims in any manner whatsoever.

DETAILED DESCRIPTION

Figure 2:
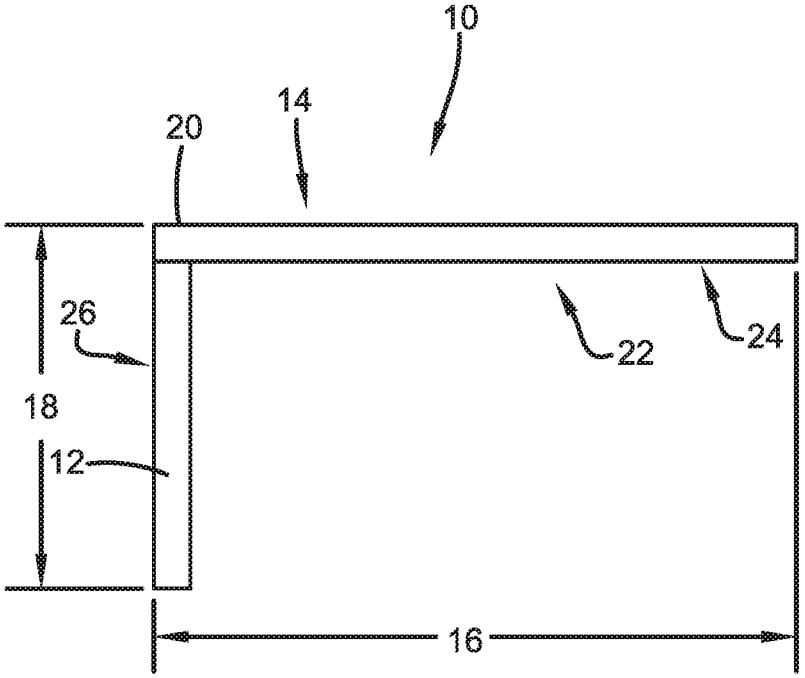
FIG. 2 is a top view of the first plate of the ladder standoff of the present disclosure shown in FIG. 1.

The present disclosure is directed to a ladder standoff for use in combination with a ladder. The ladder standoff comprises a first plate having a first portion for engaging a surface and a second portion that extends substantially perpendicular to the first portion and includes at least one opening configured for receiving a mechanical fastener. The ladder standoff further includes a first connection plate that is configured to detachably couple the first plate to a horizontal rung of a ladder. The first connection plate includes at least one opening configured for receiving a mechanical fastener. At least one of the first plate and the first connection plate includes a plurality of openings that are spaced along at least a portion of the length of either the first plate, the first connection plate, or both the first plate and the first connection plate. The length of the ladder standoff is horizontally adjustable in relation to the vertically extending ladder (ie, the length of the ladder standoff is adjustable in a direction perpendicular to the vertically extending ladder) to provide longer and shorter lengths in a direction perpendicular to the ladder. The ladder standoff is configured to accommodate a variety of distances between the ladder and the vertically extending building wall to which the ladder is secured.

According to certain illustrative embodiments, the first plate of the ladder standoff includes a plurality openings that are spaced along at least a portion of the length of the first plate. According to other illustrative embodiments, the first connection plate includes a plurality of openings that are spaced along at least a portion of the length of the first connection plate. According to yet further illustrative embodiments, the first plate of the ladder standoff includes a plurality openings that are spaced along at least a portion of the length of the first plate, and the first connection plate includes a plurality of openings that are spaced along at least a portion of the length of the first connection plate. The openings on the first plate and/or first connection plate are arranged in spaced apart columns (when viewed from the top edge to bottom edge of the plate) or rows (when from a first end to a second end of the plate) positioned along at least a portion of the length of the plates. The length of the ladder standoff is adjusted by aligning a desired column of openings of the first plate with a desired column of openings on the first connection plate, and detachably coupling the first plate to the first connection plate by passing mechanical fasteners through the aligned openings.

According to certain illustrative embodiments, the first plate of the ladder standoff comprises at least one bent plate that is configured to be detachably engaged with at least one ladder rung through at least one connection plate. The connection plate is configured to be detachably connected to both the bent plate of the ladder standoff and to a ladder rung of the ladder. The ladder may include one or more of the ladder standoffs attached to it. The ladder may include a plurality of ladder standoffs that are attached to different rungs of the ladder and that are vertically spaced along the height of the ladder. The ladder standoff secures the ladder to a vertically extending structure, such as a building wall, by attaching the one or more of the disclosed ladder standoffs to the ladder and to one or more vertically spaced points along the vertical building wall.

According to certain illustrative embodiments, the first connection plate of the ladder standoff may include at least one U-shaped slot extending from an edge of the first connection plate and that is configured to engage a portion of one ladder rung of a ladder. According to certain illustrative embodiments, the height of said U-shaped slot of the first connection plate is at least one-half of the height of the first connection plate. According to certain illustrative embodiments, the first connection plate includes at least two further slots communicating through the thickness of the first connection plate and being bordered on all sides. The height of the at least two slots is at least one-half of the height of the first connection plate. According to certain illustrative embodiments, the height of the at least two slots is about ⅔ of the height of the first connection plate. The plurality of slots enables connection of the first connection plate at various points along the slots to the bent plate and/or to a second connection plate. The height of the slots provides for vertical adjustment of the bent plate of the ladder standoff structure.

According to certain illustrative embodiments, the bent plate comprises a first portion configured to be substantially parallel with a vertically extending building wall and a second portion configured to be substantially perpendicular to a vertically extending building wall. According to certain illustrative embodiments, the second portion of the bent plate is longer than the first portion of the bent plate. According to certain illustrative embodiments, the second portion may be at least twice as long as the first portion. According to certain illustrative embodiments, the second portion may include a plurality of holes communicating through the thickness of the second portion of the bent plate. According to certain illustrative embodiments, the plurality of holes of the second portion of the bent plate may arranged in at least one column. According to certain illustrative embodiments, the second portion may include a plurality of columns with each of the plurality of columns having a plurality of holes. Each column of holes of the second portion of the bent plate are vertically spaced from lower edge of the bent plate to the upper edge of the bent plate. The columns of holes may be horizontally spaced along a least a portion of the length of the second portion of the bent plate from a first end of the second portion of the bent plate to a second opposite end of the second portion of the bent plate. According to certain illustrative embodiments, the columns of holes are substantially evenly spaced apart along a portion of the length of the second portion of the bent plate. The plurality of holes enable connection of the first connection plate, either alone or via a second connection plate, to various points along the length of the second portion of the bent plate.

According to certain illustrative embodiments, the ladder standoff may further include a second connection plate. According to certain illustrative embodiments, the second connection plate comprises a U-shaped slot extending from an edge of the second connection plate and that is configured to engage a portion of a ladder rung. According to certain illustrative embodiments, the plurality of holes of the second connection plate may arranged in at least one column. According to certain illustrative embodiments, the second connection plate may include a plurality of columns with each column having a plurality of holes. Each column of holes of the second connection plate are vertically spaced from lower edge of the second connection plate to the upper edge of the second connection plate. The columns of holes may be horizontally spaced along a least a portion of the length of the second connection plate from a first end of the second connection plate to a second opposite end of the connection plate. According to certain illustrative embodiments, the columns of holes are substantially evenly spaced apart along a portion of the length of the second connection plate. The plurality of holes enable connection of the second connection plate, either alone or via the first connection plate, to various points along the length of the first portion of the bent plate.

According to certain illustrative embodiments, the first connection plate is in adjacent contact with the second connection plate, and the second connection plate is in adjacent contact with the bent plate. According to certain illustrative embodiments, the first connection plate, the second connection plate, and the bent plate are detachably engaged with one another with at least one plurality of mechanical fasteners. According to certain illustrative embodiments, the first connection plate, the second connection plate, and the bent plate are detachably engaged with one another by a plurality of mechanical fasteners.

According to certain illustrative embodiments, provided is a ladder with at least two elongated side rails. The elongated side rails of the ladder are spaced apart and substantially parallel. The ladder includes a plurality of rungs that extend horizontally between the elongated side rails. The opposite ends of the horizontally extending ladder rungs are attached to the spaced apart elongated side rails. At least one ladder standoff is detachably connected to one or more horizontally extending ladder rungs between the spaced apart elongated side rails of the ladder. According to certain embodiments, a plurality of ladder standoffs are detachably connected to one or more horizontally extending ladder rungs between the spaced apart elongated side rails of the ladder.

According to certain illustrative embodiments, two ladder standoffs are detachably connected to the same horizontally extending ladder rung between the spaced apart elongated side rails of the ladder. According to additional illustrative embodiments, two ladder standoffs are detachably connected to each of a plurality of vertically spaced apart and horizontally extending ladder rungs between the spaced apart elongated side rails of the ladder. According to certain embodiments, the ladder standoffs are detachably attached to the same horizontally extending ladder rung at points that are equidistant from the center of the long axis of the ladder rung. According to certain embodiments, the ladder standoffs are each detachably attached to the same horizontally extending ladder rung at points that are near the opposite longitudinal ends of the ladder rung. According to yet further embodiments, the ladder standoffs are each detachably attached to the same horizontally extending ladder rung at the opposite longitudinal ends of the ladder rung and in adjacent contact with the elongated side rails of the ladder.

According to certain illustrative embodiments, the ladder also includes side guard rails extending from the top of the ladder. The side rails are positioned at the top of each spaced apart elongated side rails of the ladder. The side guard rails extend substantially perpendicularly from the top of the ladder. The side guard rails extend at least 3 feet above the upper landing surface so as to comply with OSHA requirements. According to certain embodiments, each of the side guard rails may be P-shaped guard rails.

According to certain illustrative embodiments, the ladder also includes side guard rails extending from the top of the ladder. The side rails are positioned at the top of each spaced apart elongated side rails of the ladder. A swing gate extends between to the two spaced apart side guard rails. The swing gate may be hingedly attached to one of the spaced part side guard rails. According to certain embodiments, each of the side guard rails may be P-shaped guard rails.

According to further illustrative embodiments, the ladder additionally includes a platform extending substantially horizontally from the top of the ladder. The platform comprises an elongated and substantially planar surface configured to support pedestrian traffic. The elongated and substantially planar traffic surface is supported by underlying spaced apart elongated support rails. The elongated support rails of the platform are connected to the ladder through horizontally adjustable connection assemblies. The horizontally extending platform is configured to support the weight of a person while traversing the platform from the ladder to an upper landing surface, such as a roof of a building.

The ladder may also include a vertically extending safety line assembly. The vertically extending safety line assembly includes a post, referred to in the art as an "antenna," that is attached to ladder rungs near or at the top of the ladder, and which extends vertically above the top rung of the ladder. The safety line system includes attachment modules at the top of the antenna and bottom of the ladder. The safety line assembly includes a safety line that extends vertically from the top of the antenna and the bottom of the ladder. The safety line is connected to the ladder through the upper and lower attachment modules.

Figure 1:
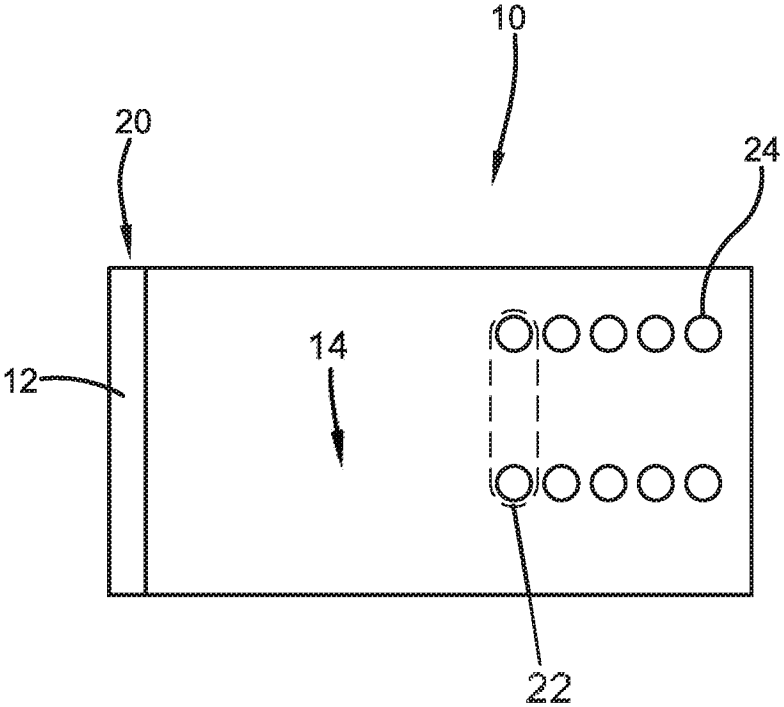
FIG. 1 is a side view of an illustrative embodiment of the first plate of the ladder standoff of the present disclosure.

FIG. 1 is a side view of a bent plate (i.e., the first plate) of the present disclosure. The bent plate 10 includes a first portion 12 and second portion 14 with a bend 20 located at the transition of the first portion 12 and the second portion 14. As shown in the illustrative embodiment in FIG. 1, the first portion 12, second portion 14 and bend 20 together form a right angle (i.e., 90° angle). The second portion 14 has a length 16 that is greater than the length of first portion 12. According to certain embodiments, the second portion 14 has a length that is at least twice the width of the first portion 12. The second portion 14 of bent plate 10 includes a plurality of apertures or holes 24. The plurality of holes 24 may be configured to receive a mechanical fastener or other connection means. The plurality of holes 24 may also be arranged into one or more hole columns 22 having more than one hole 24 in a column 22. As shown in FIG. 1, the second portion 14 of the bent plate 10 may include a plurality of hole columns 22 that are spaced apart along at least a portion of the length of second portion 14 of the bent plate 10. According to certain embodiment, the hole columns 22 may be substantially evenly spaced apart along at least a portion of the length of second portion 14 of the bent plate 10. The first portion 12 of the bent plate includes one or more second portion hole(s) 26 for anchoring the bent plate 10 to a vertically extending surface, such as a building wall. According to the illustrative embodiment shown in FIG. 1, first portion 12 of bent plate 10 includes a single second portion hole 26 that is positioned substantially in the center of first portion 12. It should be noted that first portion 12 may include any number of first portion holes 26 that are desired for an application. For illustrative embodiments that include a plurality of first portion holes 26, the plurality of such holes may be formed in first portion 12 in any suitable geometric pattern.

FIG. 2 is a top view of the bent plate of FIG. 1. The bent plate 10 includes a first portion 12 and a second portion 14 with a bend 20 located at the interface or transition of the first portion 12 and the second portion 14. The second portion 14 has a length 16, which is greater than the length 18 of the first portion 12. The second portion 14 includes at least one hole column 22 including a plurality of holes 24. The first portion 12 of the bent plate 10 includes a single hole 26.

Figure 3:
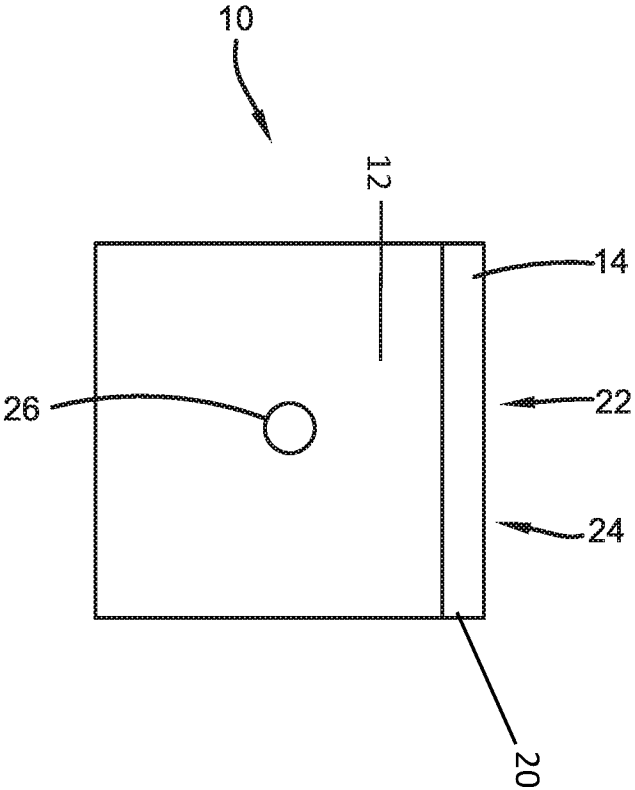
FIG. 3 is an end view of the first plate of the ladder standoff of the present disclosure shown in FIG. 1.

FIG. 3 is a side view of the bent plate 10 of FIG. 1. The bent plate 10 includes a first portion 12 and a second portion 14 with a bend 20 located at the interface or transition of the first portion 12 and the second portion 14. The first portion 12 has a length 18, which is less than half the length of the second portion 14. The first portion 12 of the bent plate 10 includes a single hole 26.

Figure 4:
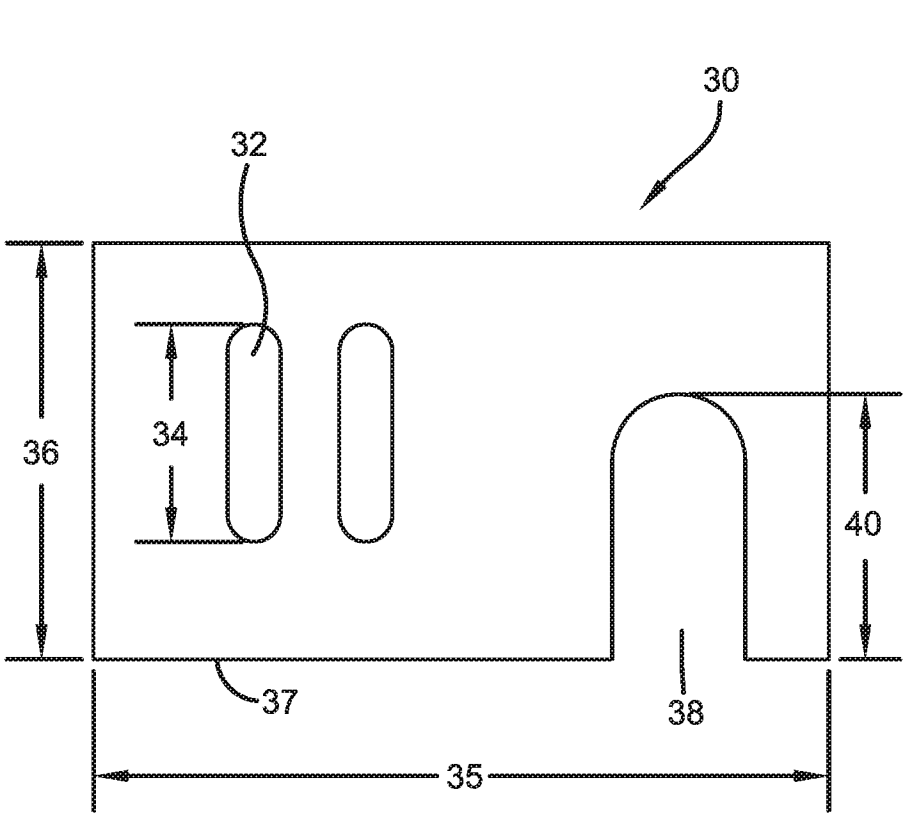
FIG. 4 is a side view of an illustrative embodiment of the first connection plate of the ladder standoff of the present disclosure.

FIG. 4 is a side view of an illustrative embodiment of the first connection plate of the present disclosure. The first connection plate 30 has a length 35 and a height 36. The first connection plate 30 includes a plurality of slots 32, which for purposes of illustration, are oblong or oval shaped. There is no limitation on the shape of the elongated slots of the first connection plate 30. The slots 32 are spaced apart along a portion of the length 35 of the first connection plate 30. Each of the slots 32 have a slot height 34. According to certain embodiments, the slot height 34 may be at least ½, ⅔, or ¾ of the entire connection plate height 36. The first connection plate 30 further includes a U-shaped slot 38 extending from a long edge surface 37 of the connection plate 30. The U-shaped slot 38 is configured to receive the portion of a horizontal ladder rung of a ladder. The U-shaped slot 38 has a height 40, which may be at least ½ or ¾ of the first connection plate height 36 of the first connection plate 30.

Figure 5:
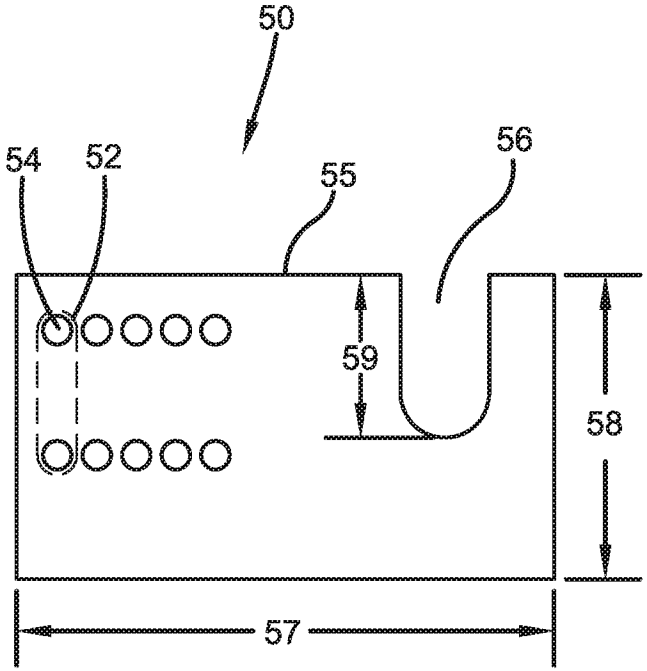
FIG. 5 is a side view of an illustrative embodiment of the second connection plate of the ladder standoff of the present disclosure.

FIG. 5 is a side view of an illustrative embodiment of the second connection plate of the present disclosure. The second connection plate 50 has length 57 and a height 58. The second connection plate 50 includes a U-shaped slot 56 extending from a long edge surface 55 of the plate 50. The U-shaped slot includes a height 59. The height 59 of the U-shaped slot may be at least ½ the second connection plate height 58. The second connection plate 50 includes a plurality of second connection plate holes 54. The plurality of second connection plate holes 54 may be arranged into one or more hole columns 52. The second connection plate 50 may include a plurality of hole columns 52 are spaced apart along at least a portion of the length 57 of the second connection plate 50. According to the embodiment shown in FIG. 5, a plurality of hole columns 52 are substantially evenly spaced apart along a portion of the length 57 of the plate 50. According to the illustrative embodiment of FIG. 5, the plate 50 includes five hole columns 52 that are substantially evenly spaced apart along a portion of the length 57 of the plate 50. Each of the hole columns 52 includes two vertically aligned and spaced apart holes 54.

Figure 6:
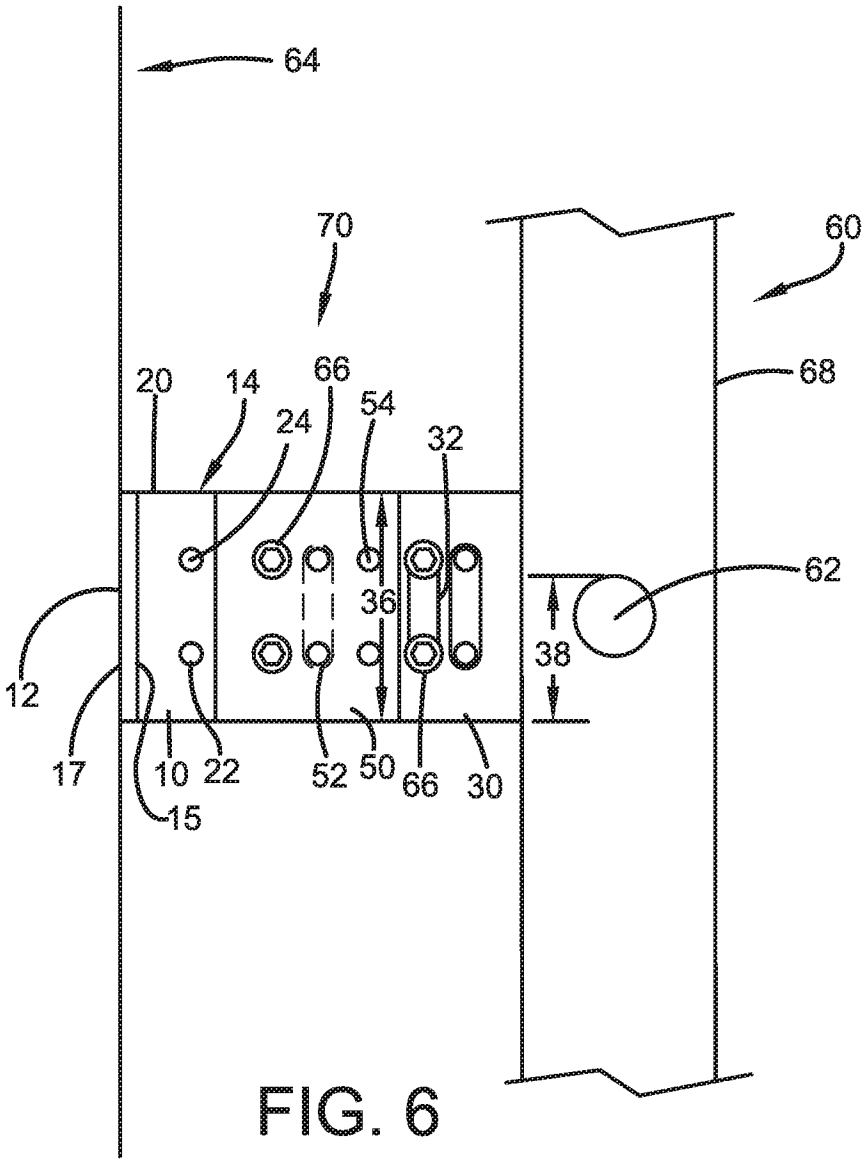
FIG. 6 is a side view of a ladder in combination with an illustrative embodiment of the ladder standoff of the present disclosure.

FIG. 6 is a side view of a ladder with the ladder standoff of the present disclosure detachably connected to a rung of the ladder. The ladder standoff 70 spaces a ladder 60 from the surface of a building wall 64. The ladder standoff 70 includes a bent plate 10 with a second portion 14 that is substantially perpendicular to the wall 64 and a first portion 12 that is substantially parallel with the wall 64. The first portion 12 of the bent plate 10 includes opposite facing first and second surfaces 15, 17. The first surface 15 of first portion 12 of bent plate 10 faces toward the ladder 60, while second surface 17 of first portion of bent plate 10 faces toward the vertically extending building wall 64. As shown in FIG. 6, second surface 17 of first portion 12 is in adjacent contact with the surface of the building wall 64 to which the ladder standoff 70 is attached.

Still referring to FIG. 6, there is a bend 20 between the first portion 12 of the bent plate 10 and the second portion 14 of the bent plate 10 which forms a right angle between first portion 12 and second portion 14, and which enables second surface 17 of first portion 12 to be placed into adjacent contact with the surface of the building wall 64. The bent plate 10 is adjacent and detachably connected to a second connection plate 50 by at least one mechanical fastener 66. The at least one mechanical fastener 66 passes through a hole 54 in the second connection plate 50 and a hole 24 in the second portion 14 of the bent plate 10. The hole 24 of the second portion 14 of the bent plate 10 may be part of a column of holes 22, and the bent plate 10 contains a plurality of such columns 22. The holes 54 of the second connection plate 50 may be arranged in hole columns 52, and the second connection plate 50 may contain a plurality of such columns 52.

The second connection plate 50 may fit around at least a portion of a ladder rung 62 via the U-shaped slot 56. The second connection plate 50 is adjacent and detachably connected to a first connection plate 30 by at least one mechanical fastener 66. The at least one mechanical fastener 66 passes through a slot 32 in the first connection plate 30 and a hole 54 in the second connection plate 50. The first connection plate 30 contains a plurality of slots 32. The first connection plate 30 includes a U-shaped slot 38 configured to fit around at least a portion of a ladder rung 62.

According to certain embodiments, the U-shaped slot 38 of the first connection plate 30 may fit over at least a portion of the top of a ladder rung 62, while the U-shaped slot 56 of the second connection plate 50 fits under and around at least a portion of the bottom of the ladder rung 62. According to certain embodiments, the U-shaped slot 38 of the first connection plate 30 may fit over at least a portion of the top of a ladder rung 62, while the U-shaped slot 56 of the second connection plate 50 fits under and around at least a portion of the bottom of the ladder rung 62, and thereby the U-shaped slots of the first connection plate 30 and second connection plate 50 combine to circumscribe the ladder rung 62.

According to certain embodiments, the U-shaped slot 38 of the first connection plate 30 may fit over at least a portion of the bottom of a ladder rung 62, while the U-shaped slot 56 of the second connection plate 50 fits under and around at least a portion of the top of the ladder rung 62. According to certain embodiments, the U-shaped slot 38 of the first connection plate 30 may fit over at least a portion of the bottom of a ladder rung 62, while the U-shaped slot 56 of the second connection plate 50 fits under and around at least a portion of the top of the ladder rung 62, and the U-shaped slots of the first connection plate 30 and second connection plate 50 combine to circumscribe the ladder rung 62. Whether by detachable connection via the second connection plate 50 or by direct detachable connection with the first connection plate 30, the first connection plate 30 detachably connects the bent plate 10 with the ladder rung 62 connected to an elongated side rail 68 of the ladder 60.

Figure 7:
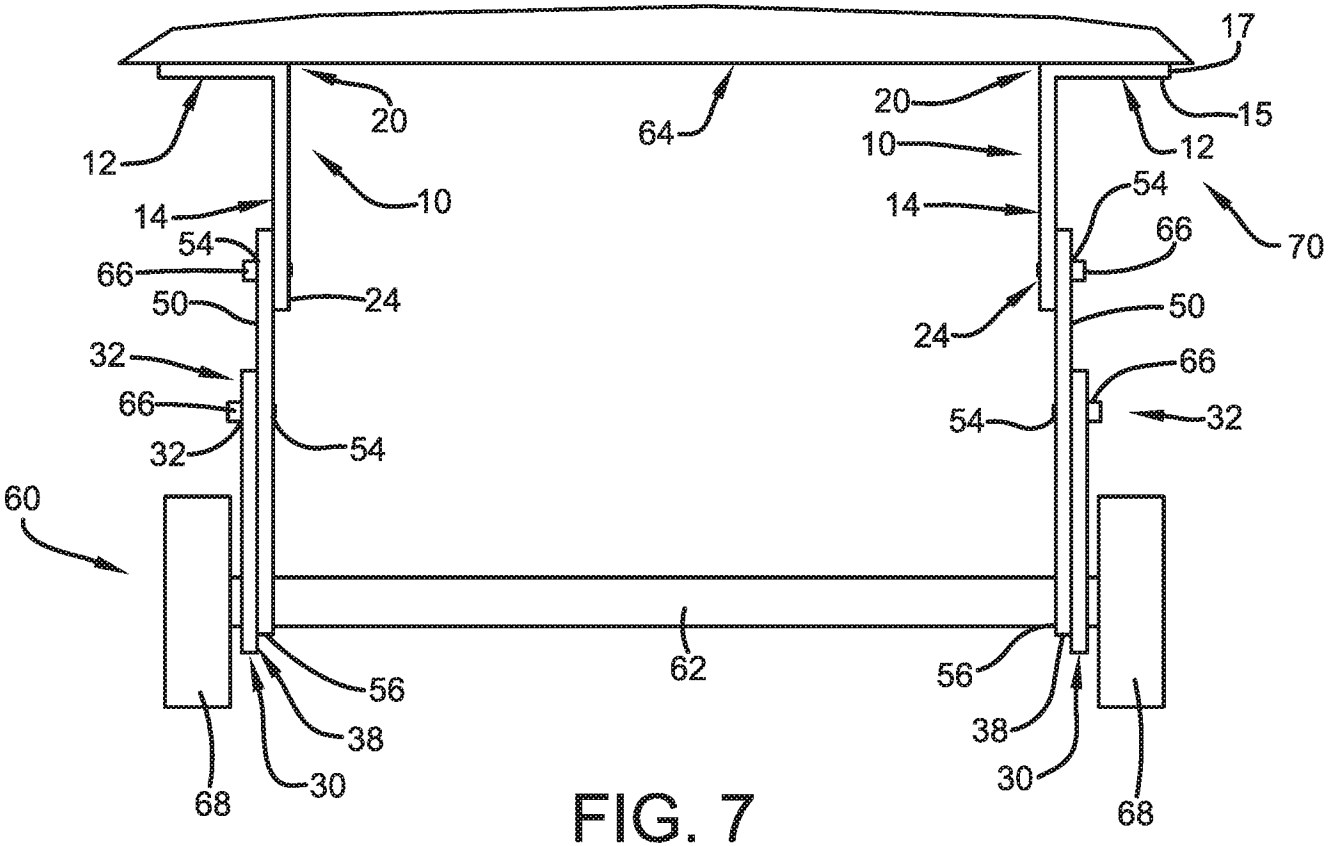
FIG. 7 is a top view of a ladder in combination with an illustrative embodiment of the ladder standoff of the present disclosure.

FIG. 7 is a top view of a ladder in combination with the ladder standoff of the present disclosure. The ladder standoff 70 spaces a ladder 60 from the surface of a building wall 64. The ladder 60 includes spaced apart and substantially parallel elongated side rails 68 with at least one rung 62 attached to the elongated side rails 68 and extending therebetween. The ladder standoff 70 includes a bent plate 10 with a second portion 14 that is substantially perpendicular to the wall 64 and a first portion 12 that is substantially parallel with the wall 64. The first portion 12 of the bent plate 10 includes opposite facing first and second surfaces 15, 17. The first surface 15 of first portion 12 of bent plate 10 faces toward the ladder 60, while second surface 17 of first portion of bent plate 10 faces toward the vertically extending building wall 64. As shown in FIG. 7, second surface 17 of first portion 12 is in adjacent contact with the surface of the building wall 64 to which the ladder standoff 70 is attached.

Still referring to FIG. 7, there is a bend 20 between the first portion 12 of the bent plate 10 and the second portion 14 of the bent plate 10 which forms a right angle between the first portion 12 and the second portion 14, which enables second surface 17 of first portion 12 to be placed into adjacent contact with the surface of the building wall 64. The bent plate 10 is adjacent and detachably connected to a second connection plate 50 by at least one mechanical fastener 66. The at least one mechanical fastener 66 passes through a hole 54 in the second connection plate 50 and a hole 24 in the second portion 14 of the bent plate 10. The hole 24 of the second portion 14 of the bent plate 10 may be part of a column of holes 22, and the bent plate 10 may contain a plurality of such hole columns 22. The holes 54 of the second connection plate 50 may be arranged in hole columns 52, and the second connection plate 50 may contain a plurality of such columns 52. The second connection plate 50 may fit around at least a portion of a ladder rung 62 with a U-shaped slot 56. The second connection plate 50 is adjacent and detachably connected to a first connection plate 30 by at least one mechanical fastener 66. The at least one mechanical fastener 66 passes through a slot 32 in the first connection plate 30 and a hole 54 in the second connection plate 50. The first connection plate 30 may contain a plurality of slots 32. The first connection plate 30 may have a U-shaped slot 38 configured to fit around at least a portion of a ladder rung 62.

According to certain embodiments, the U-shaped slot 38 of the first connection plate 30 may fit over at least a portion of the top of a ladder rung 62, while the U-shaped slot 56 of the second connection plate 50 fits under and around at least a portion of the bottom of the ladder rung 62, and the U-shaped slots of the first connection plate 30 and second connection plate 50 combine to circumscribe the ladder rung 62. According to certain embodiments, the U-shaped slot 38 of the first connection plate 30 may fit over at least a portion of the bottom of a ladder rung 62, while the U-shaped slot 56 of the second connection plate 50 fits under and around at least a portion of the top of the ladder rung 62. According to certain embodiments, the U-shaped slot 38 of the first connection plate 30 may fit over at least a portion of the bottom of a ladder rung 62, while the U-shaped slot 56 of the second connection plate 50 fits under and around at least a portion of the top of the ladder rung 62, and the U-shaped slots of the first connection plate 30 and second connection plate 50 combine to circumscribe the ladder rung 62. Whether by detachable connection via the second connection plate 50 or by direct detachable connection with the first connection plate 30, the first connection plate 30 detachably connects the bent plate 10 to the ladder rung 62 connected with an elongated side rail 68 of ladder 60.

Figure 8:
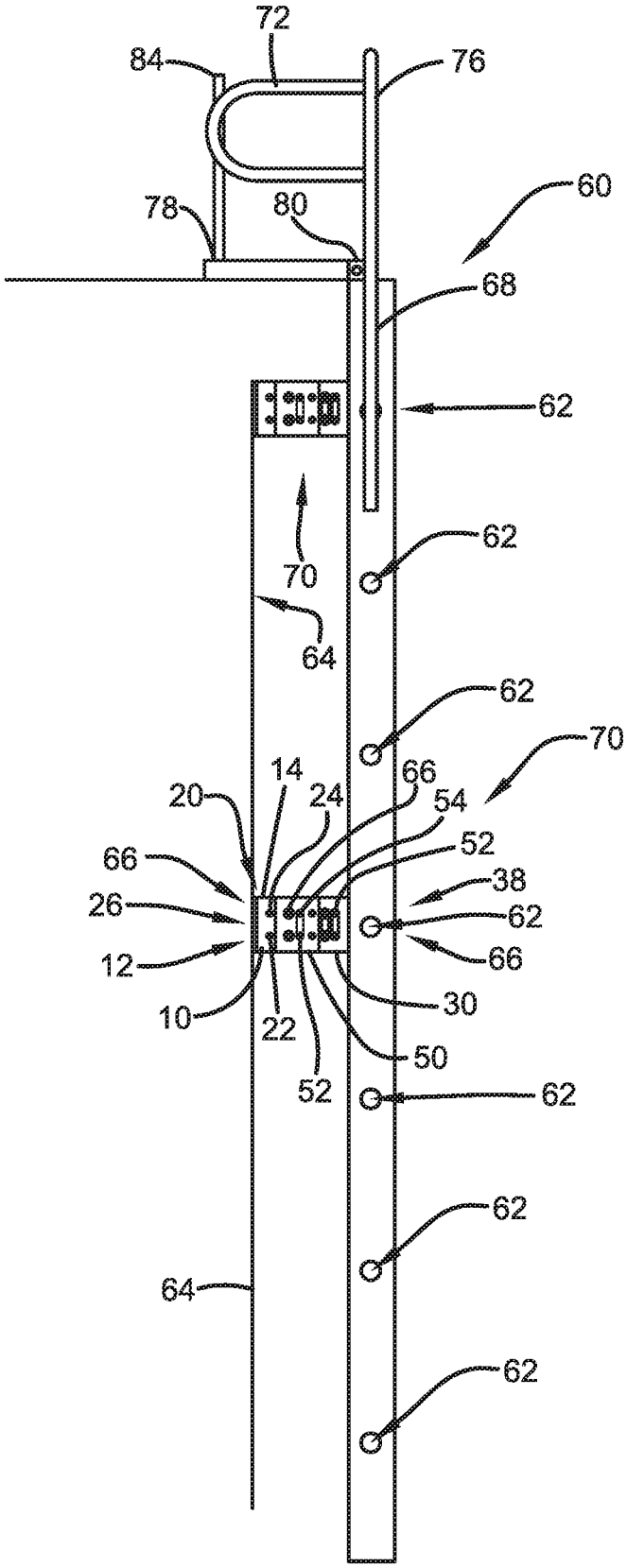
FIG. 8 is a side view of a ladder in combination with an illustrative embodiment of the ladder standoff of the present disclosure with the ladder being attached to a vertical building wall.

FIG. 8 is a side view of a ladder 60 in combination with the ladder standoff 70 of the present disclosure ladder standoff 70 spacing a ladder 60 and a vertically extending building wall 64. The ladder 60 includes spaced apart and substantially parallel elongated side rails 68 with a plurality of rungs 62 therebetween. The ladder standoff depicted in FIG. 8 comprises the ladder standoff structure detailed in FIGS. 1-7. As shown in FIG. 8, multiple ladder standoffs 70 may be included and are vertically aligned along the length of the ladder 60. The ladder standoffs 70 may be affixed to the building wall 64 by one or more mechanical fasteners 66 that are passed through holes 26 in the first portion 12 of the bent plate 10. Near the top of the ladder 60 there is a vertical support 76 affixed to the spaced apart elongated rails 68 of the ladder 60. Attached to the vertical support is a guardrail 72, which may, without limitation, comprises a P-shaped rail as shown. A platform 78 is attached to the top of a ladder standoff 70 by a standoff plate platform adapter 80. The platform 78 is capable of supporting at least the weight of a person, and extends from the ladder 60 to at least the building wall 64 between the guardrails 72, supported by the standoff plate platform adapter 80. At the end of the platform 78 opposite the ladder rung 62 is a hingedly attached swing gate 74, which is attached at least at one side to the P-shaped guardrails 72.

Figure 9:
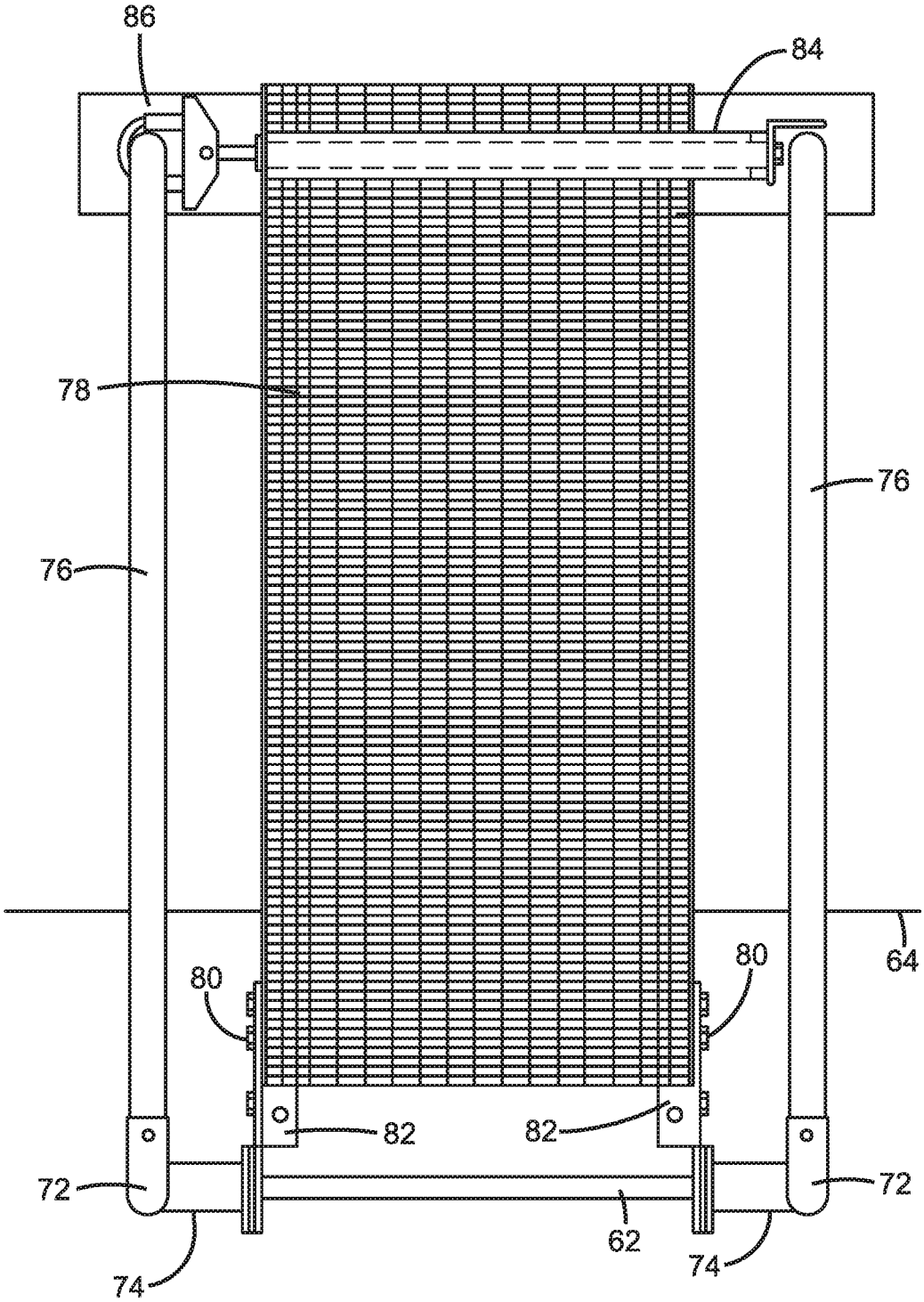
FIG. 9 is a top view of a ladder in combination with an illustrative embodiment of the ladder standoff of the present disclosure and a platform extending horizontally from the top of the ladder.

FIG. 9 is a top view of a ladder 60 spaced from a vertical wall 64. The ladder 60 includes spaced apart and substantially parallel elongated side rails 68 with at least one rung 62 extending between the side rails. Near the top of the ladder 60 there are vertical supports 72 affixed to the spaced apart elongated rails 68 of the ladder 60 arms 4. Attached to the vertical supports 72 are side guard rails 76, which may, without limitation, comprise a P-shaped rail, attached by a walkthrough arm 82. A platform 78 is attached to the top of a ladder 60 through platform connector plates 80. The horizontal surface of the platform 78 is supported by underlying platform supports 82 that extend along opposite longitudinal margins of the platform 78. The platform 78 is capable of supporting at least the weight of a person, and extends from the ladder 60 to at least the wall 64 between the guard rails 76. At the end of the platform 78 opposite the ladder rung 62 is a hingedly attached swing gate 84 attached at least at one side of the guard rails 76. Ends of the P-shaped side guard rails 76 are inserted into guard rail base support 86.

It will be understood that the embodiments described herein are merely exemplary, and that one skilled in the art may make variations and modifications without departing from the spirit and scope of the invention. All such variations and modifications are intended to be included within the scope of the invention as described and claimed herein. Further, all embodiments disclosed are not necessarily in the alternative, as various embodiments of the invention may be combined to provide the desired result.

The invention claimed is:

1. A ladder standoff comprising:

a first bent plate having a first portion for engaging a wall surface, the first portion of the first bent plate including at least one opening configured to receive a fastener to secure the first bent plate to the wall surface, and a second portion substantially perpendicular to said first portion, the second portion of the first bent plate including at least one opening configured to receive a fastener;

a first connection plate configured to detachably couple said first bent plate to a rung of a ladder, said first connection plate including a U-shaped slot configured to engage the rung of the ladder and at least one first connection plate slot configured to receive a fastener, wherein the at least one first connection plate slot includes a slot height configured to provide vertical adjustment of said first connection plate relative to said first bent plate;

wherein said at least one opening of said second portion of said first bent plate comprises a plurality of openings spaced along at least a portion of the length of said second portion of said first bent plate and/or wherein said at least one first connection plate slot comprises a plurality of first connection plate slots spaced along at least a portion of the length of said first connection plate; and a second connection plate comprising a U-shaped slot configured to engage a portion of a rung of a ladder and at least one second connection plate opening along the length of the second connection plate;

wherein said ladder standoff is horizontally adjustable and vertically adjustable in relation to the wall surface.

2. The ladder standoff of claim 1, wherein the height of said U-shaped slot of said first connection plate is at least half of the height of said first connection plate.

3. The ladder standoff of claim 1, wherein said first connection plate comprises at least two further slots, wherein the length of the at least two further two slots is at least half of the height of the first connection plate.

4. The ladder standoff of claim 3, wherein the height of the at least two further slots is about ⅔ of the height of said first connection plate.

5. The ladder standoff of claim 1, wherein said first portion of said first bent plate is configured to be substantially parallel with a wall, and wherein said second portion of said first bent plate is configured to be substantially perpendicular to a wall.

6. The ladder standoff of claim 5, wherein said second portion of said first bent plate is at least twice as long as said first portion.

7. The ladder standoff of claim 5, wherein said plurality of openings of said second portion of said first bent plate are arranged in at least one column.

8. The ladder standoff of claim 5, wherein said plurality of openings of said second portion of said first bent plate are arranged in a plurality of columns.

9. The ladder standoff of claim 8, wherein said columns are substantially evenly spaced apart along the length of said second portion of said first bent plate.

10. The ladder standoff of claim 1, wherein said at least one opening of said second connection plate comprises at least one column of a plurality of openings.

11. The ladder standoff of claim 10, wherein said second connection plate comprises a plurality of columns of a plurality of openings.

12. The ladder standoff of claim 11, wherein said columns are substantially evenly spaced apart along the length of said second connection plate.

13. The ladder standoff of claim 10, wherein said first connection plate is adjacent said second connection plate, wherein said second connection plate is adjacent said first bent plate, wherein the first connection plate is detachably engaged with said second connection plate by at least one mechanical fastener, and wherein the second connection plate is detachably engaged with said first bent plate by at least one mechanical fastener.

14. A ladder comprising:

spaced apart and substantially parallel elongated side rails;

a plurality of vertically spaced apart ladder rungs extending horizontally between said elongated side rails; and at least one ladder standoff detachably connected to at least one of said ladder rungs, said ladder standoff comprising:

a first bent plate having a first portion for engaging a wall surface, the first portion of the first bent plate including at least one opening configured to receive a fastener to secure the first bent plate to the wall surface, and a second portion substantially perpendicular to said first portion, the second portion of the first bent plate including at least one opening configured to receive a fastener;

a first connection plate configured to detachably couple said first bent plate to a rung of a ladder, said first connection plate including a U-shaped slot configured to engage the rung of the ladder and at least one first connection plate slot configured to receive a fastener, wherein the at least one first connection plate slot includes a slot height configured to provide vertical adjustment of said first connection plate relative to said first bent plate;

wherein said at least one opening of said second portion of said first bent plate comprises a plurality of openings spaced along at least a portion of the length of said second portion of said first bent plate and/or wherein said at least one first connection plate slot comprises a plurality of first connection plate slots spaced along at least a portion of the length of said first connection plate; and a second connection plate comprising a U-shaped slot configured to engage a portion of a rung of a ladder and at least one second connection plate opening along the length of the second connection plate;

wherein said ladder standoff is horizontally adjustable and vertically adjustable in relation to the wall surface.

15. The ladder of claim 14, further comprising a side guard rail extending from the top of the ladder.

16. The ladder of claim 14, further comprising a platform extending from the top of the ladder, wherein said platform is configured to support the weight of a person.

17. The ladder of claim 16, further comprising a swing gate.

* * * * *